US009551358B2

(12) United States Patent
Havard, Jr. et al.

(10) Patent No.: US 9,551,358 B2
(45) Date of Patent: Jan. 24, 2017

(54) AIR MOVING UNIT AND A HVAC SYSTEM EMPLOYING THE SAME

(75) Inventors: Harold Gene Havard, Jr., Terrell, TX (US); Geoffrey Curtis, Plano, TX (US); Miguel Montemayor, Carrollton, TX (US); Randal Poirier, The Colony, TX (US)

(73) Assignee: Lennox Industries Inc., Richardson, TX (US)

( * ) Notice: Subject to any disclaimer, the term of this patent is extended or adjusted under 35 U.S.C. 154(b) by 371 days.

(21) Appl. No.: 12/956,431

(22) Filed: Nov. 30, 2010

(65) Prior Publication Data

US 2012/0131944 A1 May 31, 2012

(51) Int. Cl.

| | |
|---|---|
| ***F25D 17/06*** | (2006.01) |
| ***F25B 1/00*** | (2006.01) |
| ***F28D 5/00*** | (2006.01) |
| ***F04D 29/60*** | (2006.01) |
| ***F24F 1/00*** | (2011.01) |

(52) U.S. Cl.

CPC ..... *F04D 29/601* (2013.01); *F24F 1/0018* (2013.01)

(58) Field of Classification Search

CPC ..... F24F 1/0018; F24F 1/0022; F24F 13/20; F24F 13/0272; F24F 2013/205; F04D 29/601; F04D 25/12; F04D 29/626; F04D 29/646

USPC ..... 62/426, 498, 411, 305, 314; 415/182.1, 415/185, 206

See application file for complete search history.

(56) References Cited

U.S. PATENT DOCUMENTS

| | | | | |
|---|---|---|---|---|
| 3,412,929 | A * | 11/1968 | Greenheck | 415/126 |
| 4,554,796 | A * | 11/1985 | Stankard | 62/326 |
| 5,749,702 | A * | 5/1998 | Datta et al. | 415/119 |
| 6,161,609 | A * | 12/2000 | Ahn | 165/41 |
| 2002/0039529 | A1* | 4/2002 | Kim | 415/206 |
| 2003/0228213 | A1* | 12/2003 | Bikos et al. | 415/101 |
| 2005/0141988 | A1* | 6/2005 | Hustvedt et al. | 415/1 |
| 2006/0010896 | A1* | 1/2006 | Choi et al. | 62/262 |
| 2006/0172693 | A1* | 8/2006 | Lundquist | 454/270 |
| 2008/0203866 | A1* | 8/2008 | Chamberlain | 312/236 |
| 2008/0302120 | A1* | 12/2008 | Kang et al. | 62/259.1 |
| 2009/0248208 | A1* | 10/2009 | Fukushima et al. | 700/275 |

OTHER PUBLICATIONS

Trane; Packaged Rooftops; Feb. 2010; 220 pages.
Aaon; High Efficiency Rooftop Unit, Quick Selection Guide; 2010; 5 pages.

* cited by examiner

*Primary Examiner* — Ryan J Walters
*Assistant Examiner* — Joseph Trpisovsky
(74) *Attorney, Agent, or Firm* — Lennox Industries Inc.; Betty Ungerman; Osman Siddiq

(57) ABSTRACT

An air moving unit, an HVAC system and an enclosed plug fan unit are disclosed. In one embodiment, the air moving unit includes: (1) a plug fan with a blower wheel and (2) a circulation enclosure. The circulation enclosure includes: (2A) a back side and (2B) a front side having an inlet orifice corresponding to an intake area of the plug fan, the front side coupled to top, left and right sides that extend therefrom to the back side to form the circulation enclosure, wherein the blower wheel is located within the circulation enclosure and the plug fan is mechanically coupled to at least one side thereof.

20 Claims, 6 Drawing Sheets

AIR MOVING UNIT AND A HVAC SYSTEM EMPLOYING THE SAME

CROSS REFERENCE TO RELATED APPLICATION

This application is related to U.S. patent application Ser. No. 13/332,740 filed by Harold Gene Havard, Jr., et al., on the same day as the present application, entitled "A SYNCHRONOUS AIR BLOWER HAVING A PERMANENT MAGNET MOTOR AND A HVAC SYSTEM EMPLOYING THE SAME", and incorporated herein by reference in its entirety.

TECHNICAL FIELD

This application is directed, in general, to Heating, Ventilating and Air Conditioning (HVAC) systems and, more specifically, to fans that are used to move air through the HVAC systems.

BACKGROUND

HVAC systems can be used to regulate the environment within an enclosed space. Typically, an air blower is used to pull air from the enclosed space into the HVAC system through ducts and push the air back into the enclosed space through additional ducts after conditioning the air (e.g., heating, cooling or dehumidifying the air). Various types of HVAC systems, such as roof top units, may be used to provide conditioned air for enclosed spaces.

A common type of air blower that is used to move air through an HVAC system is a belt-driven centrifugal scroll fan. The centrifugal scroll fan includes an impeller that is rotated by a motor via a belt to create system pressure in a HVAC unit and move the air. With the centrifugal scroll fan, there is a scroll with a circular-shape that surrounds the impeller and directs the air to a particular discharge point.

Another type of air blower that is used in HVAC systems is a plug fan. A plug fan includes an open blower wheel with exposed blades that are rotated by a motor. Typically, plug fans are installed within a fan plenum of an HVAC unit when used thereby. The motor is often a direct drive motor that rotates the blower wheel to discharge air in a 360 degree pattern and create system pressure to move air. Plug fans can operate quieter than centrifugal scroll fans since air is discharged radially instead of being forced into a single discharge point by a scroll. Additionally, since plug fans are typically fixed within a fan plenum, the insulation of the plenum can also assist in reducing fan noise.

Unfortunately, locating the plug fan within the fan plenum reduces access for maintenance. Additionally, the open blower wheel creates a danger to maintenance technicians once access to the plug fan is finally obtained. System pressure may also suffer due to the open blower wheel design.

SUMMARY

One aspect provides an air moving unit for an HVAC system. In one embodiment, the air moving unit includes: (1) a plug fan with a blower wheel and (2) a circulation enclosure. The circulation enclosure includes: (2A) a back side and (2B) a front side having an inlet orifice corresponding to an intake area of the plug fan, the front side coupled to top, left and right sides that extend therefrom to the back side to form the circulation enclosure, wherein the blower wheel is located within the circulation enclosure and the plug fan is mechanically coupled to at least one side thereof.

In another aspect, an HVAC system is disclosed. In one embodiment, the HVAC system includes: (1) a return air duct, (2) a supply air duct and (3) an air moving unit positioned in the HVAC system to pull return air from the return air duct and discharge conditioned air through the supply air duct. The air moving unit includes: (3A) a plug fan with a blower wheel, and (3B) a circulation enclosure, having a back side, and a front side having an inlet orifice corresponding to an intake area of the plug fan, the front side coupled to top, left and right sides that extend therefrom to the back side to form the circulation enclosure, wherein the blower wheel is located within the circulation enclosure and the plug fan is mechanically coupled to at least one side thereof.

In yet another aspect, an enclosed plug fan unit for an HVAC system is disclosed. In one embodiment, the enclosed plug fan includes: (1) a plug fan with a direct drive motor and a blower wheel and (2) a rectangular parallelepiped-shaped circulation enclosure including six sides, wherein the plug fan is fixed to at least one side of the circulation enclosure and the blower wheel is located within the circulation enclosure.

BRIEF DESCRIPTION

Reference is now made to the following descriptions taken in conjunction with the accompanying drawings, in which.

DETAILED DESCRIPTION

The disclosure provides an air moving unit having a plug fan with an open blower wheel that is located within a circulation enclosure. The air moving unit is a single enclosed unit that allows easier removal and installation in HVAC units compared to conventional plug fans that are fixed to the HVAC unit, such as located within a fan plenum. Thus, instead of dismantling a portion of the HVAC unit to obtain access, the disclosed air moving unit provides a serviceable plug fan that can be removed as a complete unit and serviced. This is even made easier when the air moving unit is installed on a blower deck that can be moved out of the HVAC housing for servicing. Additionally, since the open blower wheel is located within the circulation enclosure, the disclosed air moving unit provides a safer configuration for this type of air blower with exposed blades.

The circulation enclosure has multiple faces (or sides) that encompass at least the blower wheel of the plug fan. By being located within the circulation enclosure, the open blower wheel is substantially enclosed wherein access to the blades of the blower wheel is only through an inlet orifice and a supply air opening. In addition to a safer configuration, the disclosed air moving unit can improve the blower efficiencies (e.g., cubic feet per minute (CFM) per watt) and static pressure capabilities when compared to the typical open type designs of conventional plug fans. The improved efficiency can be gained due to air flow being directed by the circulation enclosure, the unobstructed mounting pattern which reduces turbulence and minimizing air leak associated with open blower designs. For an unobstructed mounting, the motor can be mounted to a back plate of the circulation enclosure using bolts to attach it thereto.

The circulation enclosure of the air moving unit, therefore, is not merely a box but a designed structure developed through testing and analysis, such as Computational Fluid Dynamics (CFD) analysis. The configuration and dimensions of the circulation enclosure are designed to correspond to the particular plug fan employed and the HVAC type for improved performance. As such, the length, height, width and shape of the circulation enclosure are not simply arbitrary or based on available space in an HVAC unit, but instead correspond to particular plug fans and HVAC units for improved performance.

Figure 1:
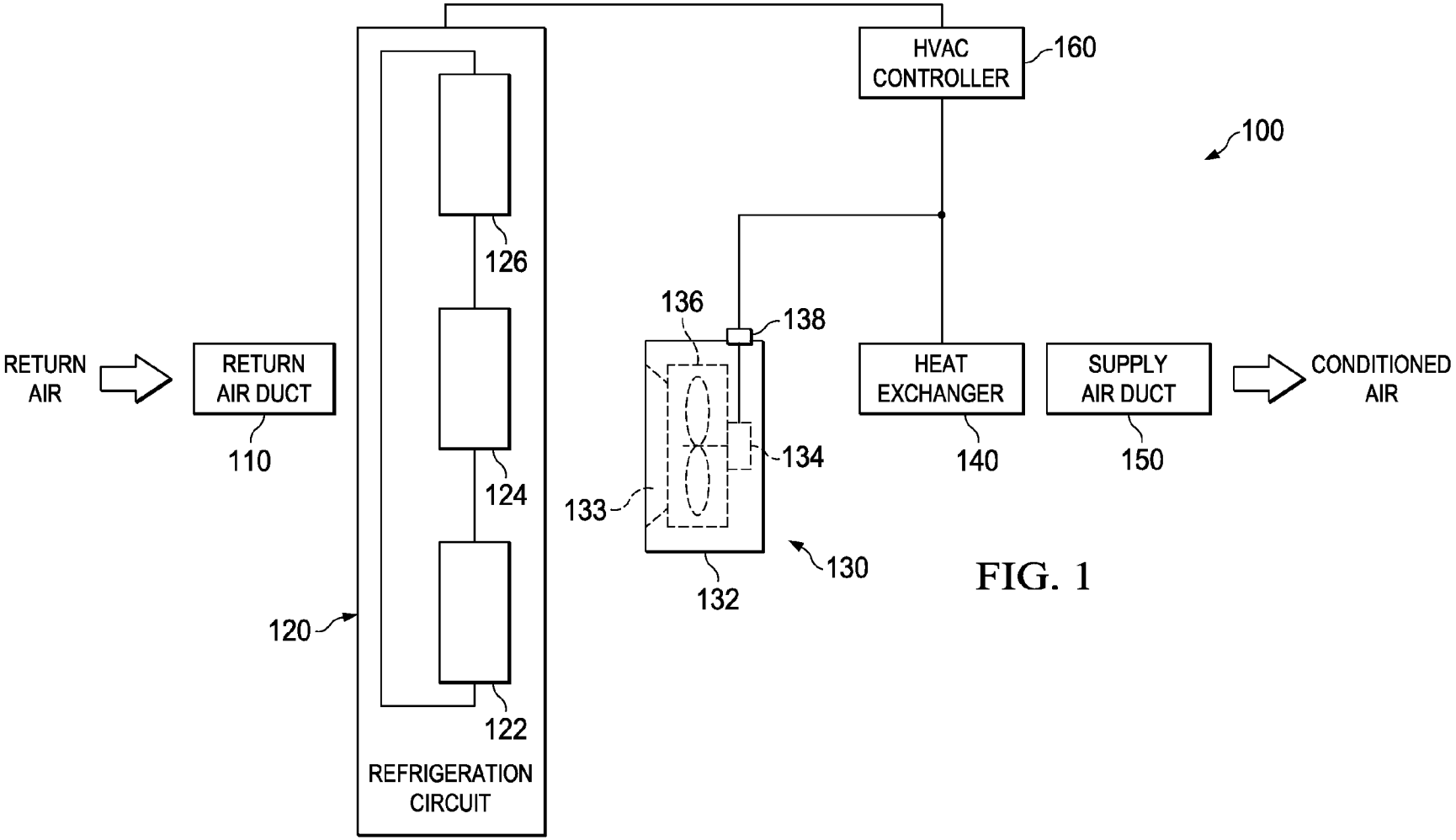
FIG. 1 illustrates a block diagram of an embodiment of an HVAC system constructed according to the principles of the disclosure.

FIG. 1 illustrates a block diagram of an embodiment of an HVAC system 100 constructed according to the principles of the disclosure. The HVAC system 100 includes a return air duct 110, a refrigeration circuit 120, an air moving unit 130, a heat exchanger 140, a supply air duct 150 and a HVAC controller 160. The refrigeration circuit 120 includes a compressor system 122, evaporator coils 124, and condenser coils 126 that are fluidly coupled together. The refrigeration circuit 120 may include multiple cooling stages.

One skilled in the art will understand that the HVAC system 100 may include additional components and devices that are not presently illustrated or discussed but are typically included in an HVAC system, such as, a power supply, an expansion valve and a condenser fan. A thermostat (not shown) is also typically employed with the HVAC system 100 and used as a user interface. The various illustrated components of the HVAC system 100 may be contained within a single housing (e.g., a cabinet). The HVAC system 100 may include multiple compartments within the housing to isolate and support the multiple components thereof. In one embodiment, the HVAC system 100 is a rooftop unit.

The return air duct 110 and the supply air duct 150 may be conventional ducts used in common HVAC systems to receive return air and discharge conditioned air. The refrigeration circuit 120, the heat exchanger 140 and the HVAC controller 160 may also be conventional devices that are typically employed in HVAC systems. The HVAC controller 160 causes the air moving unit 130 to move the return air across the evaporator coils 124 for cooling and through the heat exchanger 140 for heating to provide conditioned air for the conditioned air space. Operation of the HVAC system 100 can be controlled by the HVAC controller 160 based on inputs from various sensors of the HVAC system 100 and from a thermostat.

The air moving unit 130 is a serviceable, enclosed plug fan unit for the HVAC system 100. The air moving unit 130 includes a circulation enclosure 132, an inlet orifice 133, a direct drive motor 134 and an open blower wheel 136. In one embodiment, the open blower wheel 136 may be a backward curved blower wheel. The circulation enclosure 132 is a rectangular parallelepiped-shaped circulation enclosure. In other embodiments, the air moving unit 130 may have a different shaped circulation enclosure. The circulation enclosure 132 includes six sides that enclose both the direct drive motor 134 and the open blower wheel 136. The air moving unit 130 also includes an electrical interface 138 configured to provide a location for connecting power and control wiring from the direct drive motor 134 to a power supply and the HVAC controller 160. The electrical interface 138 may be a junction box with connectors for terminating the wiring. The electrical interface 138 allows easy installation and removal of the air moving unit 130 when both the direct drive motor 134 and the open blower wheel 136 are enclosed. In some embodiments, a portion of the direct drive motor 134 may extend out of the circulation enclosure 132 allowing access to the wiring connections of the motor 134. The electrical interface 138 may be mechanically coupled to the circulation enclosure 132 via conventional means.

In FIG. 1, a top view of the air moving unit 130 is provided with dashed lines indicating illustrated portions located under a top side of the circulation enclosure 132. The motor 134 is fixed or attached to at least one side of the circulation enclosure 132 for support and stability. The motor 134 may be fixed to a bottom side of the circulation enclosure 132 via a conventional mechanical means (not visible in FIG. 1).

Figure 2:
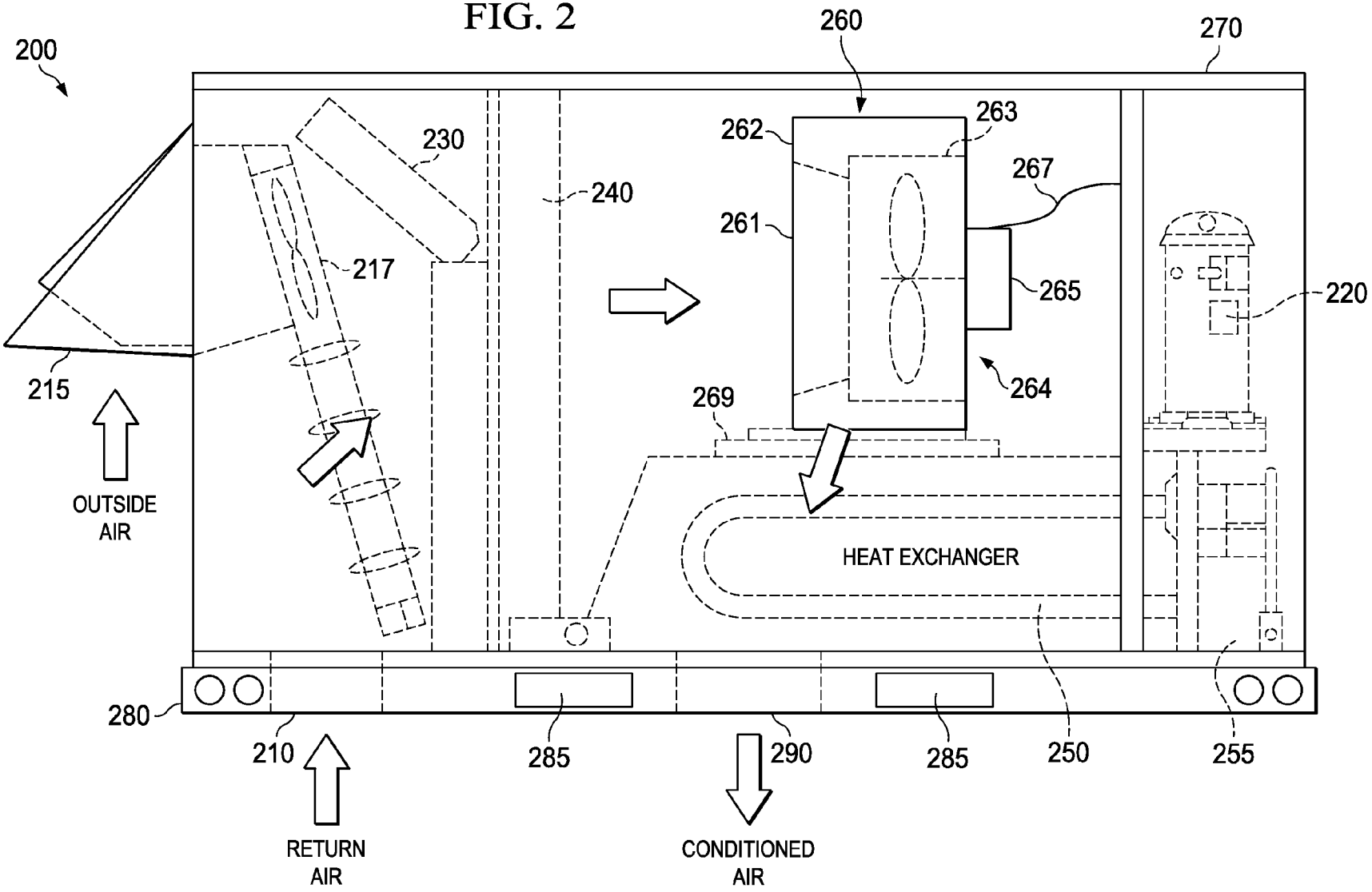
FIG. 2 illustrates a diagram of an embodiment of a HVAC system including a air moving unit constructed according to the principles of the disclosure.

FIG. 2 illustrates a side view of an embodiment of a HVAC rooftop system 200 including an air moving unit 260 constructed according to the principles of the disclosure. The HVAC rooftop system 200 includes a return air duct 210, an outdoor air duct 215, dampers 217, a compressor system 220, filters 230, an evaporator coil 240, a heat exchanger 250, a gas supply 255 and the air moving unit 260. The HVAC rooftop system 200 also includes a housing 270, a base 280 with forklift slots 285 and a supply air duct 290. The return air duct 210 and the supply air duct 290 are represented by dashed lines through the base 280 in this side view. The HVAC rooftop system 200 includes additional components that are not visible from this view due to various walls, compartments or equipment, but are typically included in conventional HVAC rooftop units. For example, the HVAC rooftop system 200 may also include a power supply, a controller, condenser coils and a condenser fan.

An air flow path through the HVAC rooftop unit 200 is represented by the arrows. Air is received in the HVAC rooftop unit 200 via the return duct 210 (i.e., return air) or the outside air duct 215 (i.e., outside air). The dampers 217 can be controlled to determine the air mixture. The received air (e.g., return, outside or a mixture thereof) is then pulled across the filters 230, the evaporator coil 240 and discharged to a conditioned space via the heat exchanger 250 and the supply air duct 290. The air discharged through the supply air duct 290 to the conditioned space may be conditioned due to either a cooling mode or a heating mode of the HVAC rooftop unit 200.

The air moving unit 260 pulls the received air via an inlet orifice 261 and discharges conditioned air through the supply air duct 290 via a supply air opening (not visible in FIG. 2) of the air moving unit 260. The air moving unit 260 is a single, enclosed fan assembly that includes a circulation enclosure 262 and, located therein, a plug fan 264 with a direct drive motor 265 and an open blower wheel 263. The blower wheel 263 may be a backward curved blower wheel. The circulation enclosure 262 includes a front side having the inlet orifice 261 that corresponds to an intake area of the plug fan 264. The circulation enclosure 262 also includes a back side on an opposing side of the front side. Coupled to the front side are top, left and right sides that extend therefrom to the back side to form the circulation enclosure around the blower wheel 263 of the plug fan 264. The motor 265 of the plug fan 264 extends through a motor opening on the back side. In this embodiment, the plug fan 264 may be mechanically coupled to the back side for support. A fan mount may be used to secure the plug fan 264 to the back side. Power and control wiring 267 is connected to the motor 265 via conventional means and coupled to a power supply and a controller (not visible).

The HVAC rooftop unit 200 also includes a blower deck 269 in which the air moving unit 260 is mounted. The blower deck 269 is typically constructed to slide or roll to allow easier access to the air moving unit 260. The blower deck 269 is usually constructed of a metal sufficiently rigid to support the air moving unit 260. The blower deck 269 may be coupled to the base 280 for support. The blower deck 269 also includes an opening (not visible) that corresponds to the supply air opening and the supply air duct 290 for discharging air. In some embodiments, the air moving unit 260 may not have a bottom side. In such embodiments, the air moving unit 260 may be coupled to the blower deck 269 and employ the top of the blower deck 269 for a bottom side. In other embodiments having a bottom side, the air moving unit 260 may be coupled to the blower deck 269 via the bottom side.

Figure 3:
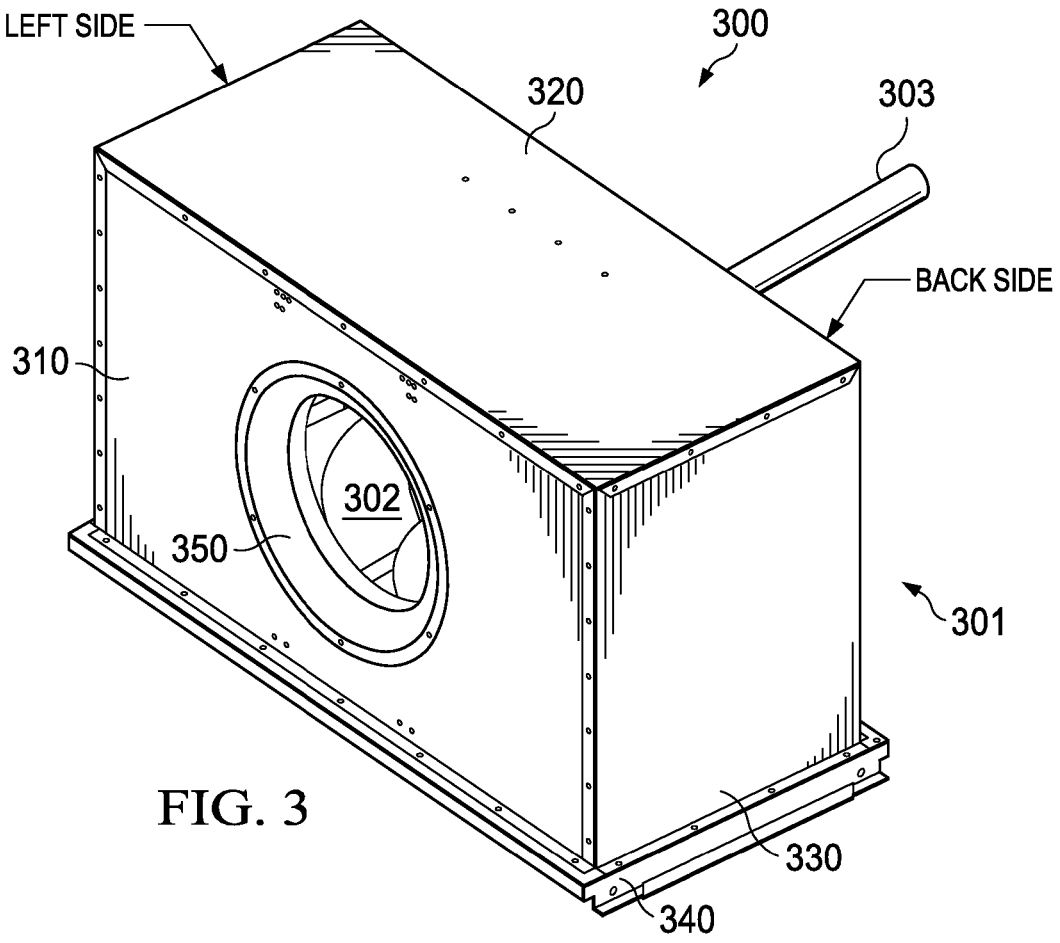
FIG. 3 illustrates a diagram of an embodiment of an air moving unit constructed according to the principles of the disclosure.

FIG. 3 illustrates an isometric view of an embodiment of an air moving unit 300 constructed according to the principles of the disclosure. The air moving unit 300 includes a circulation enclosure 301 and a plug fan 302 (wherein blades of the blower wheel are visible). The circulation enclosure 301 has a front side 310, a top side 320, a right side 330 and a bottom side 340. Additionally, the air moving unit 300 includes a back side and a left side that are not visible in FIG. 3. The sides of the circulation enclosure may be a type of metal, such as galvanized steel. In the illustrated embodiment, the plug fan 302 is at least substantially enclosed by the sides of the circulation enclosure 301.

The air moving unit 300 also includes an inlet orifice 350 for pulling air into the circulation enclosure 301 and discharging air out a supply air opening (not visible) located on the bottom side 340. The blades of the blower wheel may be backward curved blades that create a pressure when rotated to move air through an HVAC system. The plug fan 302 is a belt driven fan wherein a fan shaft 303 extends through the back side of the circulation enclosure 301 to be coupled to a motor via a belt for rotating. Of course, as illustrated in other embodiments, a plug fan with a direct drive motor may be used.

Figure 4:
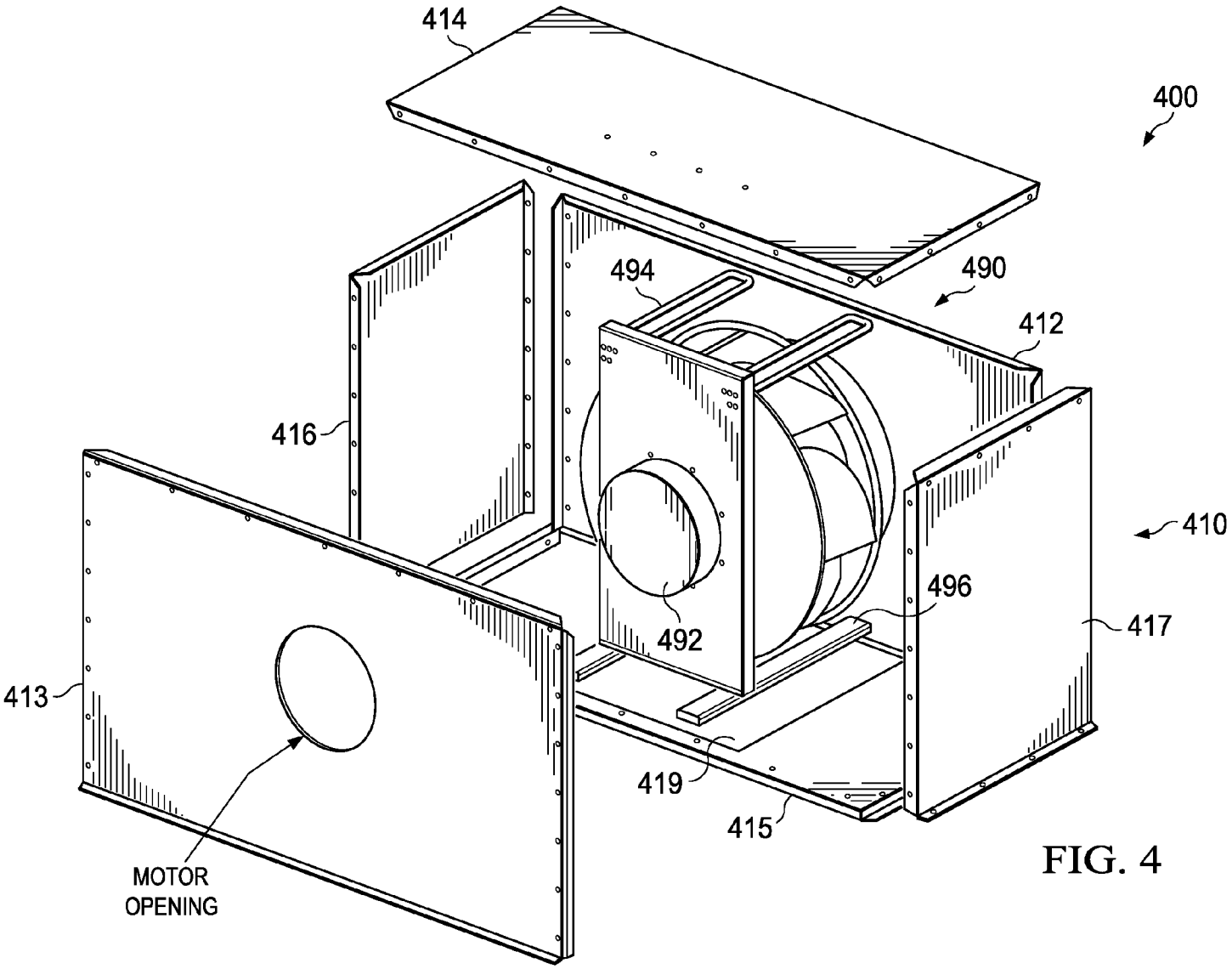
FIG. 4 illustrates an exploded view of an embodiment of a air moving unit constructed according to the principles of the disclosure.

FIG. 4 illustrates an exploded view of an embodiment of a air moving unit 400 constructed according to the principles of the disclosure. The service plug fan 400 includes a circulation enclosure 410 and a plug fan 490. The circulation enclosure 410 includes a front side 412, a back side 413, a top side 414, a bottom side 415, a right side 416 and a left side 417. The edges of each of the multiple sides includes a flange for connecting to each other. Additionally, a type of sealant may be used to reduce air leaks. For example, aluminum duct tape may be placed around the edges to prevent leaks.

The front side 412 includes an inlet orifice (not visible) wherein received air is pulled in by the plug fan 490. The bottom side 415 includes a supply air opening 419. The plug fan 490 includes a direct drive motor 492, an open blower wheel 494 and a mounting structure 496. The mounting structure 496 is coupled to the front side 412 and the back side 413. A conventional mechanical means may be used to couple the mounting structure 496 to the different sides. The mounting structure 496 fixes the plug fan to the circulation enclosure 410 and supports the plug fan 490. In addition, the mounting structure 496 stabilizes the plug fan 490 when operating. In this illustrated embodiment, the direct drive motor 492 is located within the circulation enclosure 410. In other embodiments, the direct drive motor 492 may extend through an opening in the back side 413, a motor opening, that is denoted by the dashed circle.

Figure 5A:
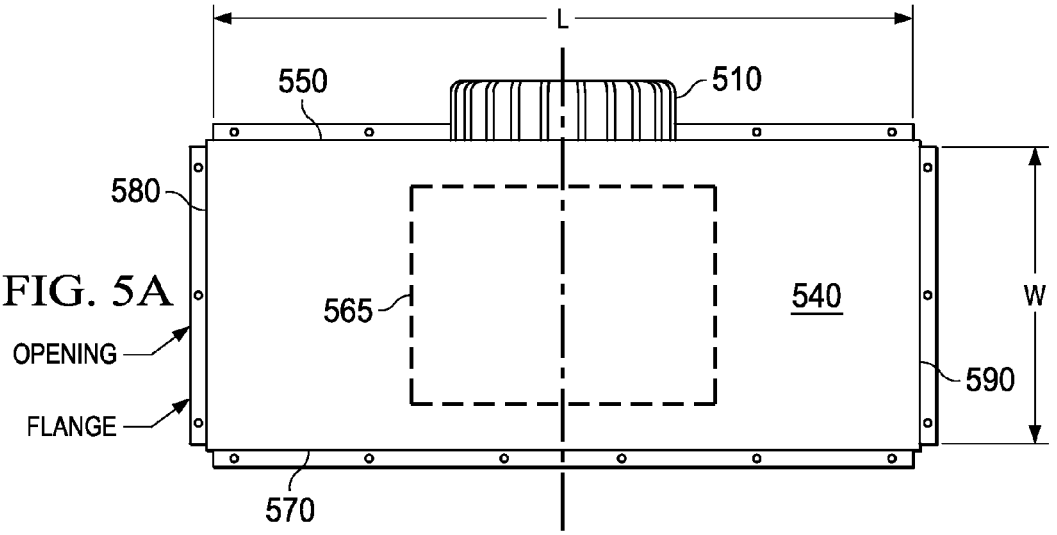
FIG. 5A, FIG. 5B and FIG. 5C illustrate different layout views of an embodiment of a air moving unit constructed according to the principles of the disclosure.
Figure 5B:
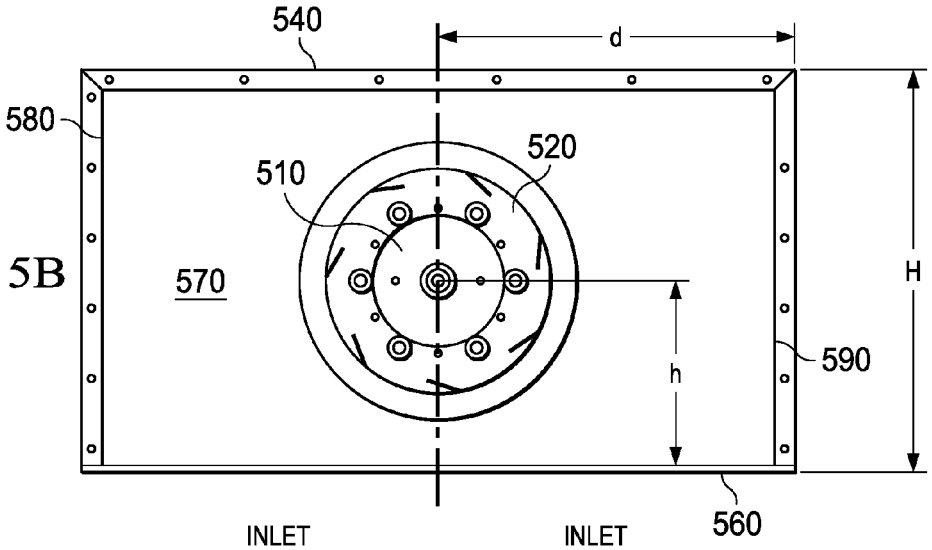
Figure 5C:
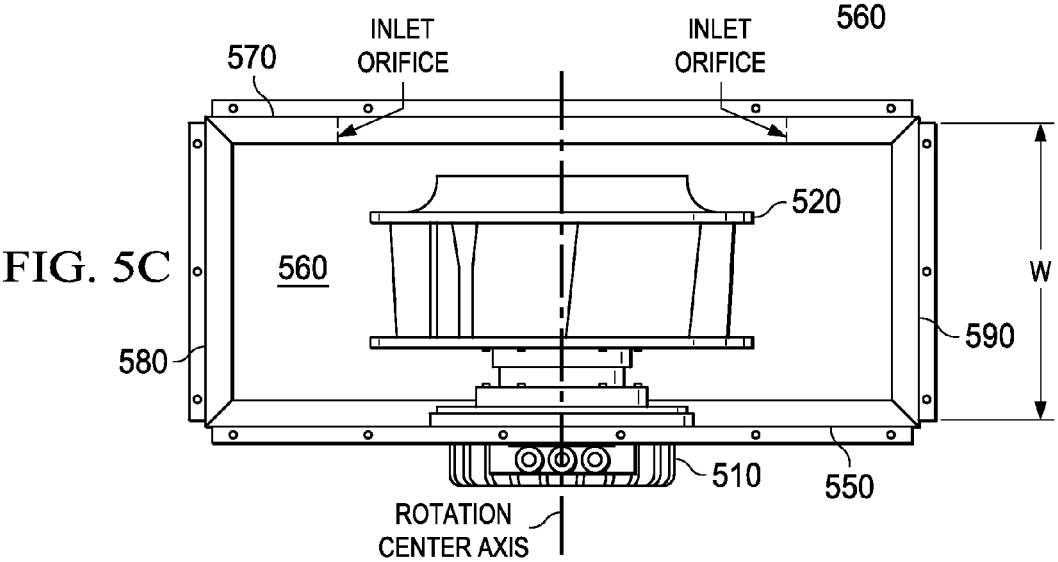

FIG. 5A, FIG. 5B and FIG. 5C illustrate different layout views of an embodiment of an air moving unit 500 constructed according to the principles of the disclosure. The air moving unit 500 includes a plug fan and a circulation enclosure having multiple sides. Various components of the plug fan are illustrated in the figures including a direct drive motor 510 and an open blower wheel 520. In the different views provided by FIGS. 5A, 5B and 5C, various sides of the circulation enclosure are also illustrated, including a top side 540, a back side 550 and a bottom side 560. A front side 570, a left side 580 and a right side 590 are also denoted. Flanges of the various sides and opening in the flanges are also illustrated and a single flange and opening are denoted in FIG. 5A. The flanges and openings are used to couple the various sides together to form the circulation enclosure. Screws may be employed through the openings to secure the sides together. One skilled in the art will understand that other mechanical means may be employed to couple the sides together to form the circulation enclosure.

The back side 550 has a motor opening wherein a portion of the direct drive motor 510 protrudes therefrom. The direct drive motor 510 can be mounted directly to the back side 550 through conventional means.

FIG. 5A provides a top view with the top side 540 included. FIG. 5B provides a view from the front with the front side 570 included. FIG. 5C provides a view from the bottom. Though not visible from the top view of FIG. 5A, a supply duct opening 565 is illustrated to provide reference. Similarly, an inlet orifice is denoted in FIG. 5C. A rotation center of axis is illustrated in all three figures. As illustrated in FIG. 5C, the rotation center axis of the plug fan corresponds to the center of the inlet orifice.

The multiple sides form a circulation enclosure having a rectangular parallelepiped shape. A length (L) of the circulation enclosure along a first axis that is perpendicular to the rotation axis is greater than a width along a second axis that is parallel with the rotation axis. The location of the plug fan within the circulation enclosure may vary depending on the type of HVAC unit the air moving unit 500 is employed. As such, the rotation center axis may be centered or off-centered on the back side 550 with respect to the distance between the left side and the right side. For example, the shaft offset distance, d, may be equal to half of L, greater than half of L or less than half of L. The mounting height, h, of the plug fan from the bottom side 560 may also vary depending on the type of HVAC unit in which the air moving unit 500 is employed and the dimensions of the plug fan that is used.

Figure 6:
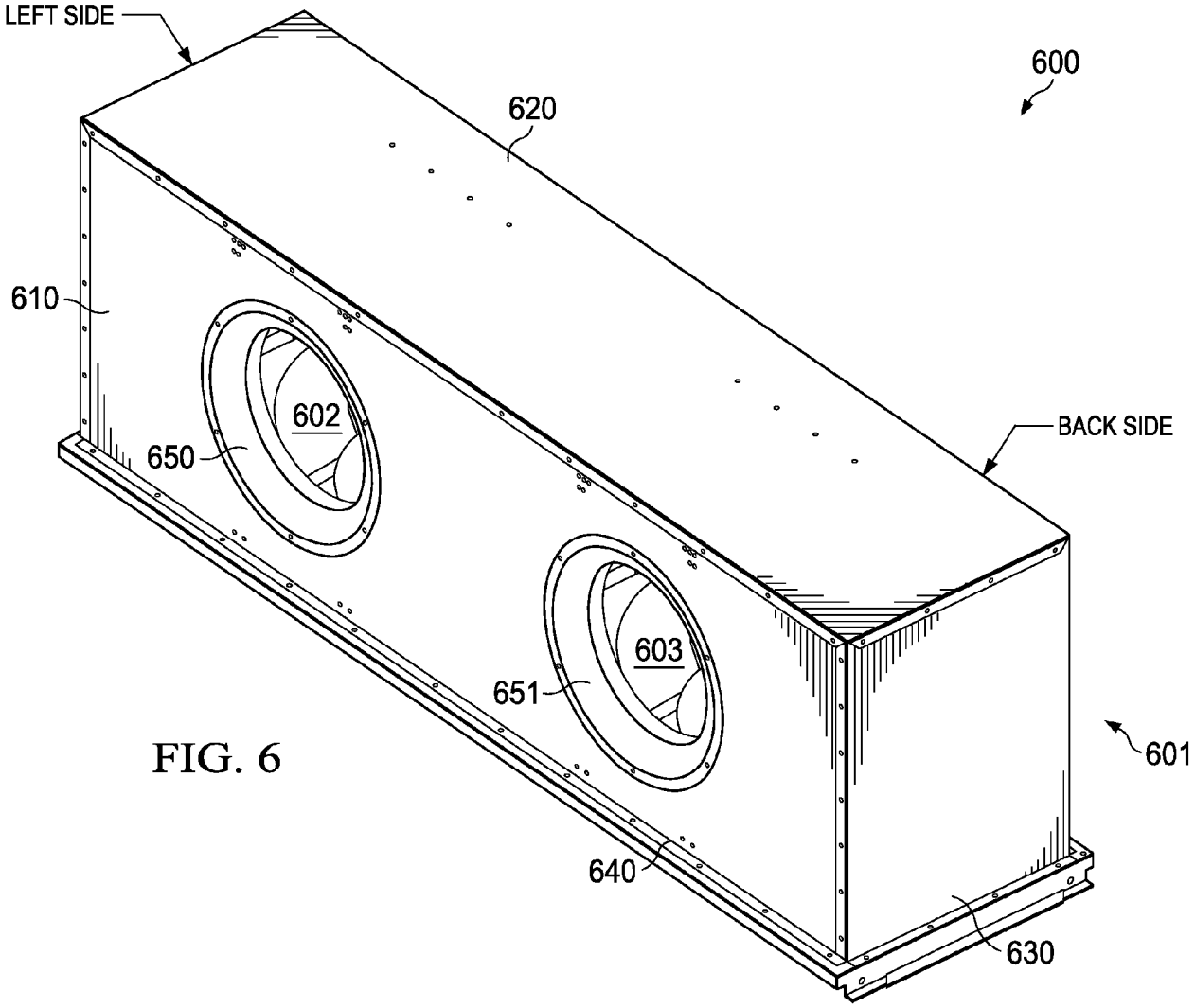
FIG. 6 illustrates an isometric view of another embodiment of an air moving unit constructed according to the principles of the disclosure.

FIG. 6 illustrates an isometric view of another embodiment of an air moving unit 600 constructed according to the principles of the disclosure. The air moving unit 600 includes a circulation enclosure 601, a first plug fan 602 and a second plug fan 603 (wherein blades of the blower wheels are visible). As such, the air moving unit 600 is constructed similar to the other air moving units disclosed herein with an additional plug fan. In other embodiments, more than two plug fans may also be employed. Like the other embodiments, the circulation enclosure 601 has a front side 610, a top side 620, a right side 630 and a bottom side 640.

Additionally, the air moving unit 600 includes a back side and a left side that are not visible in FIG. 6. In the illustrated embodiment, the plug fans 602, 603, are at least substantially enclosed by the sides of the circulation enclosure 601.

The air moving unit 600 also includes two inlet orifices 650, 651, for pulling air into the circulation enclosure 601 and discharging air out a supply air opening (not visible) located on the bottom side 640. The blades of the blower wheels may also be backward curved blades that create a pressure when rotated to move air through an HVAC system.

The disclosed air moving units with circulation enclosures can lower the indoor blower watts, raise net capacity and improve unit efficiency compared to conventional units. In contrast to open blower designs, the disclosed air moving units with circulation enclosures can allow higher static pressures. The disclosed air moving units with circulation enclosures, therefore, provide serviceable plug fans that can be used to provide more efficient and easier to maintain HVAC units.

Those skilled in the art to which this application relates will appreciate that other and further additions, deletions, substitutions and modifications may be made to the described embodiments. For example, the supply air opening may be located on different sides of the circulation enclosure than the bottom side. In some embodiments, the supply air opening may be on the left side, the right side, the back side or the top side. The location of the supply air opening may depend on the configuration of the HVAC unit in which the air moving unit is employed.

What is claimed is:

1. An air moving unit for an HVAC system having a housing, comprising:

a plug fan comprising a blower wheel; and a circulation enclosure removably couplable to said HVAC system within said housing, the circulation enclosure comprising:

a back side, a front side, a top side, a left side, a right side, and a bottom side;

said front side having an inlet orifice corresponding to an intake area of said plug fan, said front side mechanically coupled to said top, bottom, left and right sides that extend therefrom to said back side to form said circulation enclosure;

wherein said blower wheel is located within said circulation enclosure and said plug fan is mechanically coupled to at least one side thereof, wherein each side of said circulation enclosure is distinct from said housing;

wherein said left, top, and right sides of the circulation enclosure are non-permeable to air; and wherein said blower wheel in said circulation enclosure is only accessible through said inlet orifice and a supply air opening when said housing is removed.

2. The air moving unit as recited in claim 1 wherein said bottom side has said supply air opening.

3. The air moving unit as recited in claim 1 wherein a shape of said circulation enclosure is based on said plug fan and said HVAC system.

4. The air moving unit as recited in claim 1 wherein said plug fan includes a direct drive motor and said back side has a motor opening and a portion of said direct drive motor protrudes therefrom.

5. The air moving unit as recited in claim 1 wherein a rotation center axis of said plug fan corresponds to the center of said inlet orifice.

6. The air moving unit as recited in claim 5 wherein said circulation enclosure has a rectangular parallelepiped shape.

7. The air moving unit as recited in claim 6 wherein said circulation enclosure has a length along a first axis that is perpendicular to said rotation axis and a width along a second axis that is parallel with said rotation axis, wherein said length is greater than said width.

8. The air moving unit as recited in claim 1 wherein said plug fan is a first plug fan, said air moving unit further comprising a second plug fan located within said circulation enclosure.

9. An HVAC system, comprising:

a return air duct;

a supply air duct;

a housing; and an air moving unit removably coupled to said HVAC system within said housing and positioned therein to pull return air from said return air duct and discharge conditioned air through said supply air duct, said air moving unit including:

a plug fan comprising a blower-wheel, and a circulation enclosure, comprising:

a back side, a front side, a top side, a left side, a right side, and a bottom side; and said front side having an inlet orifice corresponding to an intake area of said plug fan, said front side mechanically coupled to said top, bottom, left and right sides that extend therefrom to said back side to form said circulation enclosure;

wherein said blower wheel is located within said circulation enclosure and said plug fan is mechanically coupled to at least one side thereof, wherein each side of said circulation enclosure is distinct from said housing;

wherein said left, top, and right sides of the circulation enclosure are non-permeable to air; and wherein said blower wheel in said circulation enclosure is only accessible through said inlet orifice and a supply air opening when said housing is removed.

10. The HVAC system as recited in claim 9 further comprising a compressor, a coil fluidly coupled to said compressor and a heat exchanger, wherein said plug fan is positioned to pull said return air across said coil.

11. The HVAC system as recited in claim 10 further comprising a blower deck wherein said air moving unit is removably coupled thereto via a mechanical connection.

12. The HVAC system as recited in claim 11, wherein said bottom side is opposite said top side and is removably coupled to said blower deck.

13. The HVAC system as recited in claim 12 wherein said bottom side has said supply air opening fluidly coupled to said supply air duct for discharging said conditioned air.

14. The HVAC system as recited in claim 9 wherein said air moving unit further comprises an electrical interface configured to connect said plug fan to a controller of said HVAC system.

15. The HVAC system as recited in claim 9 wherein said plug fan has a direct drive motor and said back side has a motor opening and a portion of said direct drive motor protrudes therefrom.

16. The HVAC system as recited in claim 9 wherein a rotation center axis of said plug fan corresponds to the center of said inlet orifice.

17. The HVAC system as recited in claim 16 wherein said circulation enclosure is a rectangular parallelepiped.

18. The HVAC system as recited in claim 17 wherein said circulation enclosure has a length along a first axis that is perpendicular to said rotation axis and a width along a second axis that is parallel with said rotation axis, wherein said length is greater than said width and dimensions of said circulation enclosure are based on said plug fan and said HVAC system.

19. The HVAC system as recited in claim 9 wherein only two sides of said circulation enclosure have openings for circulating air by said plug fan.

20. An enclosed plug fan unit for an HVAC unit having a controller, a blower deck and a housing, comprising:

a plug fan comprising a direct drive motor and a blower wheel;

an electrical interface configured to connect said direct drive motor to said controller;

a rectangular parallelepiped-shaped circulation enclosure removably couplable to said HVAC system within said housing and including six sides, wherein said plug fan is fixed to at least one side of said circulation enclosure and said blower wheel is located within said circulation enclosure, wherein said six sides are unique from sides of said housing and are mechanically fixed together to form said rectangular parallelepiped-shaped circulation enclosure;

wherein said six sides comprise a back side, a front side, a top side, a left side, a right side, and a bottom side, said front side having an inlet orifice corresponding to an intake area of said plug fan;

wherein said left, top, and right sides of said rectangular parallelepiped-shaped circulation enclosure are non-permeable to air; and wherein said blower wheel in said circulation enclosure is only accessible through said inlet orifice and a supply air opening when said housing is removed.

* * * * *